US008347871B2

(12) United States Patent
Irvine

(10) Patent No.: US 8,347,871 B2
(45) Date of Patent: Jan. 8, 2013

(54) WET CUTTING SAW

(76) Inventor: Robert Andrew Irvine, Buddina (AU)

( * ) Notice: Subject to any disclaimer, the term of this patent is extended or adjusted under 35 U.S.C. 154(b) by 151 days.

(21) Appl. No.: 12/995,023

(22) PCT Filed: May 26, 2009

(86) PCT No.: PCT/AU2009/000658

§ 371 (c)(1),
(2), (4) Date: Feb. 23, 2011

(87) PCT Pub. No.: WO2009/143567

PCT Pub. Date: Dec. 3, 2009

(65) Prior Publication Data

US 2011/0146648 A1 Jun. 23, 2011

(30) Foreign Application Priority Data

May 30, 2008 (AU) ..... 2008902732

(51) Int. Cl.
*B28D 1/04* (2006.01)

(52) U.S. Cl. ..... 125/13.01; 451/453; 451/455

(58) Field of Classification Search ..... 125/13.01; 451/453, 455

See application file for complete search history.

(56) References Cited

U.S. PATENT DOCUMENTS

| | | | | |
|---|---|---|---|---|
| 1,824,000 | A * | 9/1931 | Walter | 125/13.01 |
| 4,080,952 | A * | 3/1978 | Wain | 125/13.01 |
| 4,414,783 | A | 11/1983 | Vincent | |
| 6,422,228 | B1 * | 7/2002 | Latham | 125/13.01 |
| 6,796,890 | B1 * | 9/2004 | Goldrick | 125/12 |
| 7,114,494 | B2 | 10/2006 | Baratta | |
| 7,241,211 | B2 | 7/2007 | Baratta | |
| 2005/0034715 | A1 | 2/2005 | Terpstra | |

FOREIGN PATENT DOCUMENTS

| | | | |
|---|---|---|---|
| FR | 2644723 | A1 | 9/1990 |
| WO | 2004/065080 | A2 | 8/2004 |
| WO | 2006/096921 | A1 | 9/2006 |

OTHER PUBLICATIONS

International Preliminary Report on Patentability and Written Opinion issued in corresponding International Application No: PCT/AU2009/000658, dated Nov. 30, 2010, 5 pages.

* cited by examiner

*Primary Examiner* — Maurina Rachuba
(74) *Attorney, Agent, or Firm* — Rothwell, Figg, Ernst & Manbeck, P.C.

(57) ABSTRACT

A wet cutting saw comprising: a blade rotatable about an axis; a liquid feed conduit for feeding liquid onto a surface of the blade as it rotates; a hood comprising a top wall located above the blade and a side wall located to one side of the blade and connected to the top wall; the wet cutting saw also comprising at least one collector for collecting liquid which leaves the blade surface as it rotates, each collector located at the side wall of the hood and arranged to recycle the collected liquid to the blade surface.

15 Claims, 4 Drawing Sheets

SECTION A

WET CUTTING SAW

CROSS REFERENCE TO RELATED APPLICATIONS

This application is a 35 U.S.C. §371 National Phase Entry Application from PCT/AU2009/000658, filed May 26, 2009, and designating the United States, which claims priority under 35 U.S.C. §119 to Australia Patent Application No. 2008902732 filed May 30, 2008, which is incorporated herein in its entirety.

FIELD OF THE INVENTION

The present invention relates to wet cutting saws.

BACKGROUND OF THE INVENTION

Wet cutting saws are typically used to cut through hard materials such as concrete, bitumen, rock, bricks and tiles. Water (or another suitable liquid) is fed onto the circular blade of the wet cutting saw primarily to act as a coolant for the blade as the heat created by the friction of the blade as it rotates to cut the hard materials is quite substantial. The water is also added to clean the teeth of the saw blade (should it have teeth) and to flush cuttings out of the cut formed by the blade. Typically, the water used with the wet cutting saw forms a slurry with particles of the hard material which are formed during the cutting process.

In many applications of wet cutting saws, it is necessary to provide adequate control over flow of the water and slurry away from the wet cutting saw. Such applications may include when cutting inside buildings such as shopping centres and in circumstances where it is necessary to protect the environment from such flows. Conventionally, this has been achieved by vacuuming up the slurry and water run-off which flows away from the blade. For small wet cutting saws, this may be readily achieved by a single person operating a hand held vacuum.

Recent developments in wet cutting saws have seen a significant increase in the power of the saws. These more powerful cutting saws more readily cut through concrete, rock and other such hard materials thus enabling faster use of the saws. One consequence, however, of these more powerful saws is that more water is required to cool the blade, which in turn means that controlling the flow of water and slurry away from the blade is more difficult. As a result, either the speed of use of the wet cutting saw is limited, despite its greater power, or operators of the cutting saws have to employ more than one manually operated vacuum or even industrial vacuum pumps to control the water and slurry flow away from the blade (at considerable additional cost to the operator).

U.S. Pat. No. 5,477,844 proposes a solution to the problem of controlling water and slurry flow away from the blade based on use of a vacuum. The wet cutting saw of U.S. Pat. No. 5,477,844 has a saw blade house within a blade guard. Expandable bellows fit over the blade guard and are fixed to a drag bar which can be lowered onto the ground. The drag bar has a vacuum chamber open to the space inside the slurry containment section (where the blade is located). Application of a vacuum on the vacuum chamber draws the water and slurry into the chamber and then to a separator tank where the solids can be separated from the water. However, the wet cutting saw of U.S. Pat. No. 5,477,844 has not found commercial acceptance. Furthermore, it does not resolve the problem of requiring high vacuuming power for high flows of water to more powerful cutting saws.

SUMMARY OF THE INVENTION

According to an aspect of the present invention, there is provided a wet cutting saw comprising:

a blade rotatable about an axis;

a liquid feed conduit for feeding liquid onto a surface of the blade as it rotates;

a hood comprising a top wall located above the blade and a side wall located to one side of the blade and connected to the top wall;

the wet cutting saw also comprising at least one collector for collecting liquid which leaves the blade surface as it rotates, each collector located at the side wall of the hood and arranged to recycle the collected liquid to the blade surface.

The blade is generally circular and has an axis of rotation that passes through the centre of the blade.

The blade may be mounted on and driven by any suitable axle.

The blade may or may not have teeth.

The liquid used in the operation of the wet cutting saw is typically water but may be any other suitable liquid or liquid mixture such as oil for example.

Each collector may comprise a groove, channel or trough formed in or on the side wall.

Each collector is located at a surface of the side wall which faces the blade.

Each collector may be elongate.

Each collector may be angled with respect to the horizontal.

Each collector may have a first end and a second end, wherein each collector slopes from its first end to its second end so that liquid flows from the first end to the second end.

The first end of each collector may be located near the perimeter of the side wall and the second end of each collector may be located towards the centre of the side wall.

In another arrangement, the first end of each collector may located on one end of the side wall and the second end of each collector may be located on an opposing end of the side wall. Hence, in this arrangement, each collector extends between the ends of the side wall.

Each collector may comprise an elongate member projecting from a surface of the side wall.

Each elongate member may be of any suitable shape. For example, in one arrangement one or more of the elongate members may be substantially planar and extends from the surface of the side wall at an angle of less than 90°. In another arrangement, one or more of the elongate members is bent or angled. Generally, each elongate member forms a trough or channel.

Each collector may comprise one or more openings for directing liquid from the collector onto the surface of the blade.

Each opening may be arranged so that liquid falls from the opening onto the blade surface.

Each opening may be spaced away from the blade surface, preferably by 0.5-10 mm.

Each opening may be provided at the end of a projection projecting from the collector towards the blade.

In another arrangement, the wet cutting saw may also comprise a dam for holding liquid which falls from one or more of the openings in the collectors, the dam arranged to recycle liquid to the blade surface.

The dam may be located on an inner surface of the side wall.

The dam may receive liquid from all of the collectors.

The dam may be arranged to recycle liquid to the blade surface.

The dam may extend between the side wall and the blade surface.

At least an edge of the dam proximate to the blade may be formed of rubber or any other suitable material.

An edge of the dam may touch the blade surface.

Where the wet cutting saw comprises two side walls with collectors located at each wall, the saw may comprise at least two dams, one dam located at each side wall.

The dam may be positioned close to the axle of the blade.

The dam may be in the form of a trough.

The dam may comprise a substantially flat floor member extending between the inner surface of the side wall and the blade surface.

The dam may comprise wall members on either side of the floor member extending between the inner surface of the side wall and the blade surface.

The floor member may be inclined towards the blade surface.

Typically, where each collector comprises one opening, it is located towards the second end of the collector.

In another arrangement, each collector may be arranged to direct liquid to a liquid outlet conduit of the hood and is configured to return liquid from the liquid outlet conduit to the blade surface. This may be via the liquid feed conduit or may be via a separate conduit.

The liquid collected in the collector may carry some solid particles. The wet cutting saw may comprise a liquid-solid separator for separating the solids from the liquid which is directed to the liquid outlet conduit. The separated liquid may then be returned to the blade surface.

The hood may comprise a further side wall connected to the top wall and opposing the other side wall.

The top wall may space apart the side walls.

The blade is generally located between the two side walls.

The wet cutting saw may also comprise at least one collector located at this further side wall for collecting liquid which leaves the blade surface as it rotates. The at least one collector located on the further side wall may have any one more of the features of the at least one collector described above.

Each side wall may have an approximately semi-circular shape. Each side wall may, however, be of any suitable shape, including rectangular.

The top wall may be curved or may be planar.

The liquid feed conduit may feed liquid to the blade surface between the centre of the blade and the blade's edge.

The liquid feed conduit may feed liquid to both surfaces of the blade.

The liquid feed conduit may comprise any suitable arrangement to feed liquid to the blade surface or surfaces.

The liquid feed conduit may extend through the hood.

The liquid feed conduit may comprise a nozzle or nozzles for feeding liquid onto the surface(s) of the blade.

The liquid feed conduit may comprise a nozzle located on either side of the blade.

BRIEF DESCRIPTION OF THE DRAWINGS

Embodiments of the present invention will now be described, by way of example only, with reference to the accompanying drawings, in which.

DETAILED DESCRIPTION OF EMBODIMENTS

Figure 1:
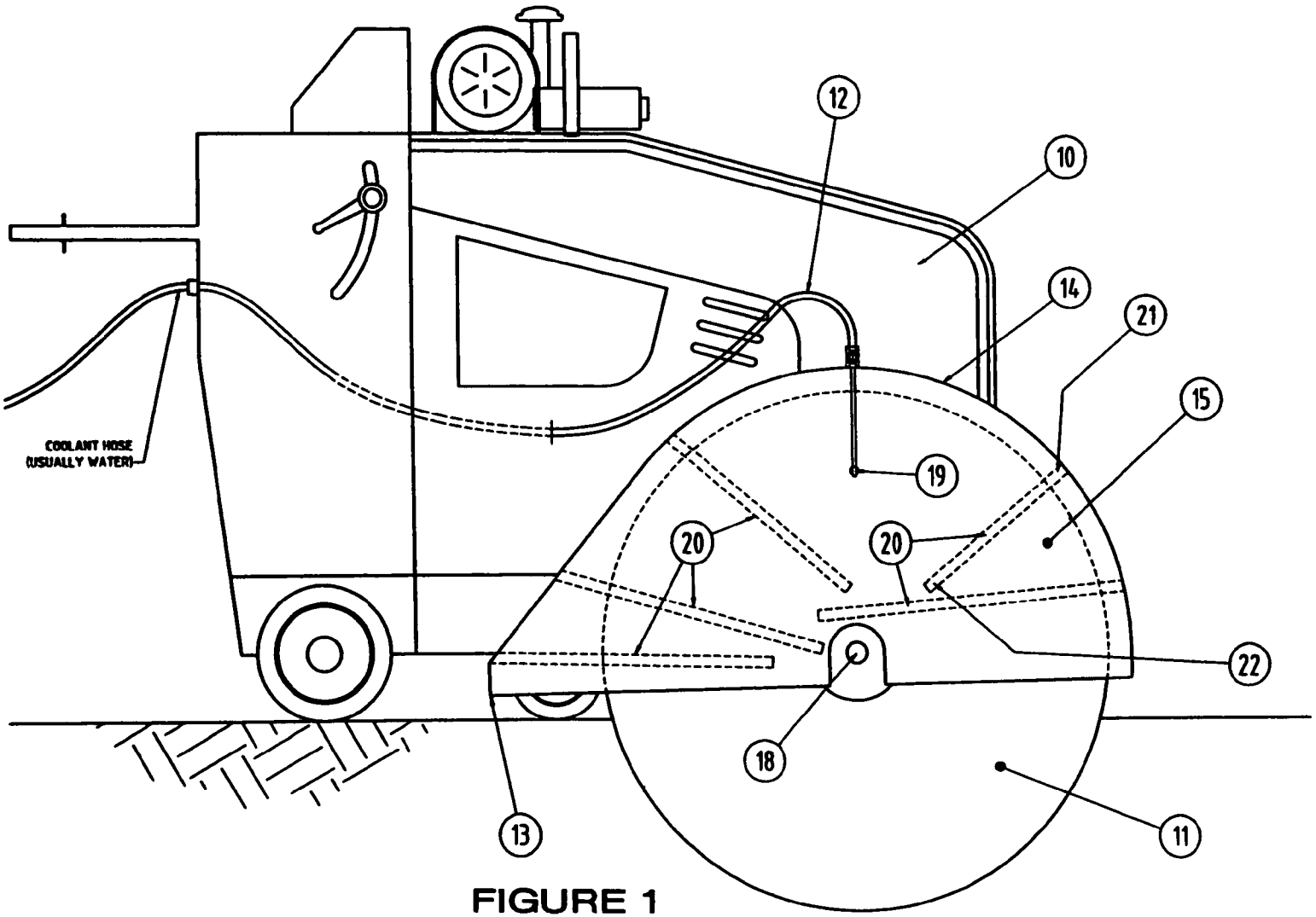
FIG. 1 is a side schematic view of a wet cutting saw according to an embodiment of the present invention.
Figure 2:
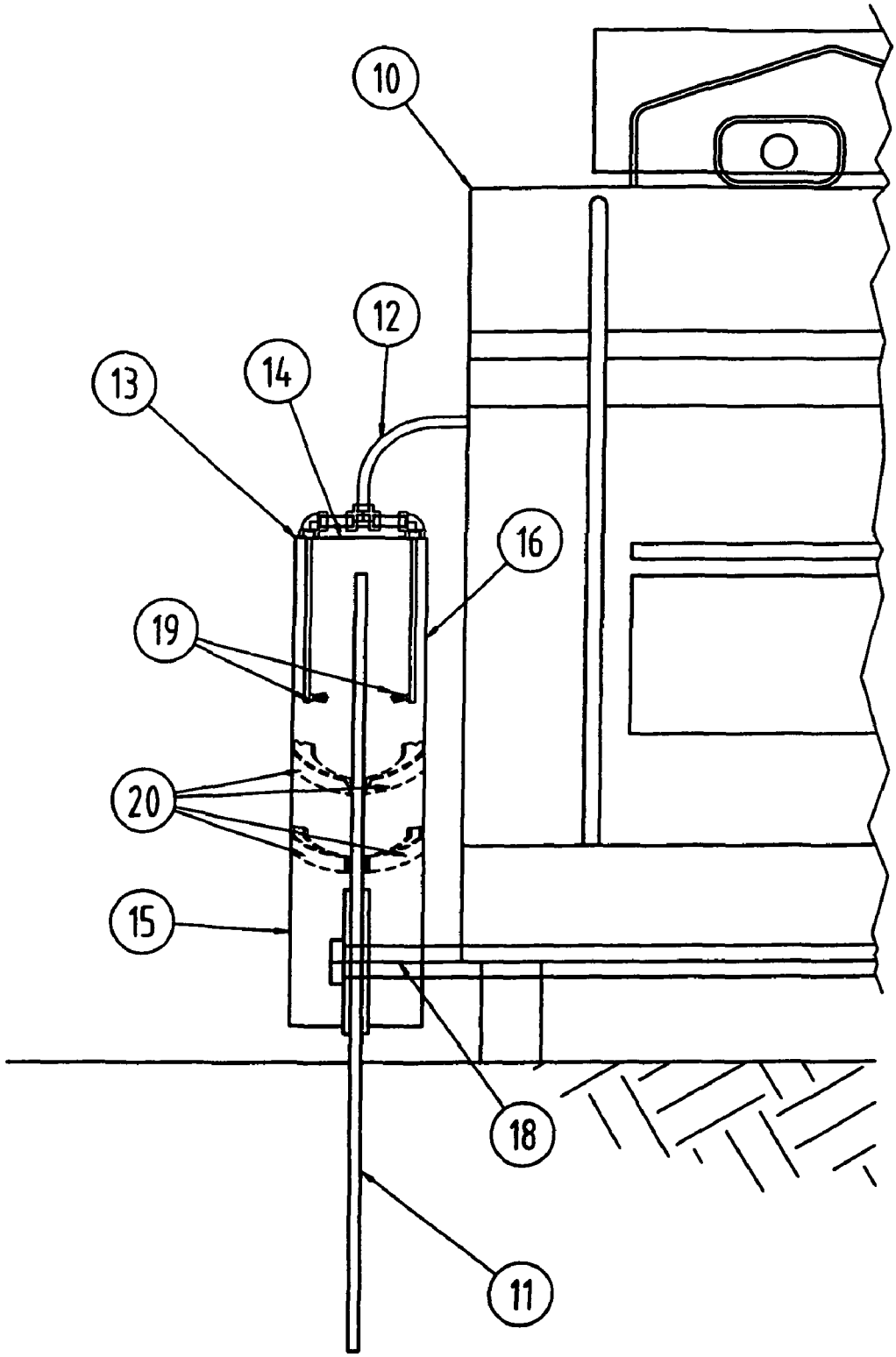
FIG. 2 is a cut-away front schematic view of the wet cutting of FIG. 1.

Referring to FIGS. 1 and 2, a wet cutting saw 10 according to an embodiment of the present invention is shown. The saw 10 comprises a blade 11, rotatable about an axis, a liquid feed conduit 12 for feeding liquid (typically water or other suitable liquid) onto a surface of the blade 11 as it rotates and a hood 13. The hood 13 comprises a top wall 14 located above the blade 11 and side walls 15, 16 located either side of the blade 11 and connected to the top wall 14. The hood 13 acts generally as a conventional wet cutting saw guard against inadvertent contact of a person with the blade 11 and to prevent liquid and slurry from being sprayed in all directions from the rotating blade 11. The wet cutting saw also comprises a number of collectors 20 located at each side wall 15, 16 of the hood 13 for collecting liquid which leaves the blade surface as it rotates and recycling the collected liquid to the blade surface.

The wet cutting saw 10 operates on the principal identified by the inventor that a large proportion of the liquid that leaves the blade 11 as it rotates (ie. under centrifugal forces) is moving upward from the blade 11 to impact the top wall 14 of the hood 13. It has further been discovered that the majority of liquid thrown from the blade 11 onto the top wall 14 runs down the side walls 15, 16. Thus, the collectors 20 are appropriately positioned to collect the liquid as it runs down the side walls 15 hence enabling greater control over the flow of liquid and slurry away from the wet cutting saw 10.

Of course it is to be understood that the wet cutting saw may have a hood with only one side wall, which would most probably be located to the side of the blade which does not face the body of the wet cutting saw. Furthermore, whilst the wet cutting saw 10 of FIGS. 1 and 2 is shown having multiple collectors 20, the wet cutting saw according to embodiments of the present invention may have only one collector.

The blade 11, which may or may not have teeth, is generally circular and has an axis of rotation that passes through the centre of the blade 11. As shown in the Figures, the blade 11 is mounted on and driven by an axle 18. The axle 18, may connected to any suitable motive source.

Each side wall 15, 16 of the hood 13 has an approximately semi-circular shape but could be any suitable shape, including rectangular. Accordingly, the top wall 14 of the hood 13 is curved. Thus the hood 13 forms a hollow approximately semi-circular prism which fits over and around the blade 11. At least some portion of the 11 is exposed below the bottom of the hood 13 so as to enable the blade 11 to contact the material being cut.

As shown in all of the Figures, the liquid feed conduit 12 feeds liquid to both surfaces of the blade 11. The liquid feed conduit 12 feeds liquid to the blade surfaces between the centre of the blade and the blade's edge. As the blade 11 rotates in use, the liquid being fed to the blade's surfaces moves out to the blade's edge under the centrifugal forces generated by the rotating blade 11. The liquid feed conduit 12 extends through the hood 13 and comprises a nozzle or nozzles 19 located on either side of the blade 11 for feeding liquid onto the surfaces of the blade 11. However, any other suitable arrangement of liquid feed conduit for feeding liquid to the blade 11 may be employed.

Each collector 20 comprises an elongate member projecting from the inner surface of one of the side walls 15, 16. The elongate members form a channel or trough in which liquid may be collected as it runs down the side walls 15, 16. The elongate members may be of any suitable shape and may be integrally formed with respective side walls 15, 16 or may be formed separately and connected thereto. For example, they may be substantially planar and extend from the surface of the side wall at an angle of less than 90°. However, in another arrangement, the elongate member may be bent or angled. In a further variation to that shown in the Figures, each collector 20 may comprise grooves formed in the side walls 15, 16.

Each collector 20 has a first end 21 and a second end 22, wherein each collector 20 slopes from its first end 21 to its second end 22 so that liquid flows from the first end 21 to the second end 22. In the embodiments shown in Figures, the first end 21 of each collector 20 is located near the perimeter of its respective side wall 15, 16 and the second end 22 of each collector 20 is located towards the centre of its respective side wall 15, 16.

In the embodiment shown in FIGS. 1 and 2, the sloping or angling of each collector 20 facilitates recycling of liquid to the surface of the blade 11 by directing flow of the collected liquid towards the second end 22 of each collector. Located at the second end 22 of each collector is a projection 24 having an opening 25 for directing liquid from the collector 20 onto the surface of the blade. As shown in FIG. 2 the projection 24 of each collector 20 is formed by a bend in the collector 20 towards the blade. In this arrangement, the collected liquid can fall from the opening 25 onto the blade surface. Each opening is spaced away from the blade surface by a suitable distance, generally 0.5-10 mm. This is to enable the blade to have sufficient clearance from the collectors 20 as it rotates, yet does not require the liquid to travel overly far from the collector 20 to the blade surface. It is to be understood that each collector 20 may be formed with multiple projections projecting towards the blade to enable liquid to be recycled to the blade surface at multiple locations from each collector.

Figure 3:
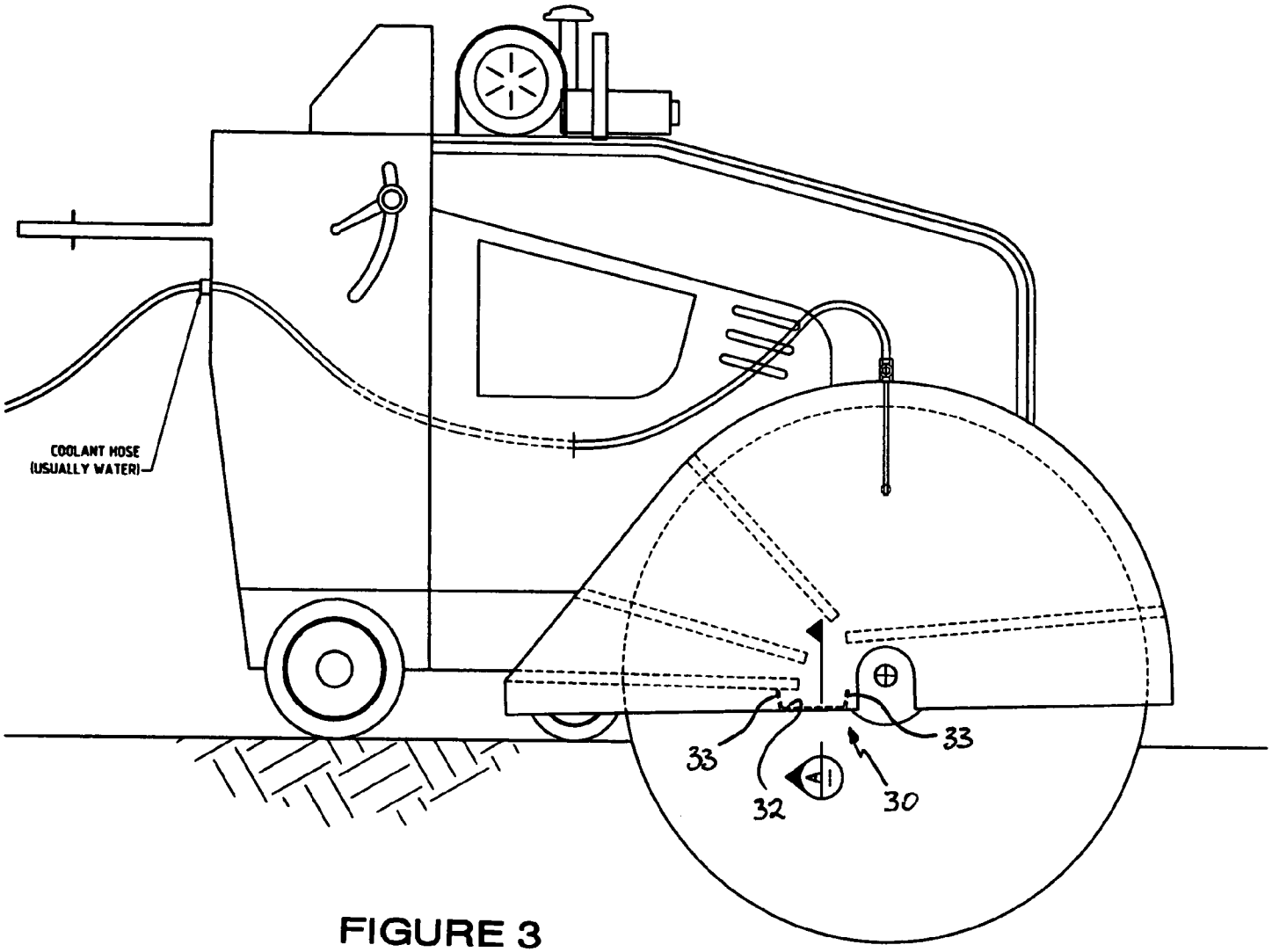
FIG. 3 is a side schematic view of a wet cutting saw according to an embodiment of the present invention similar to that shown in FIG. 1, but incorporating a dam.
Figure 4:
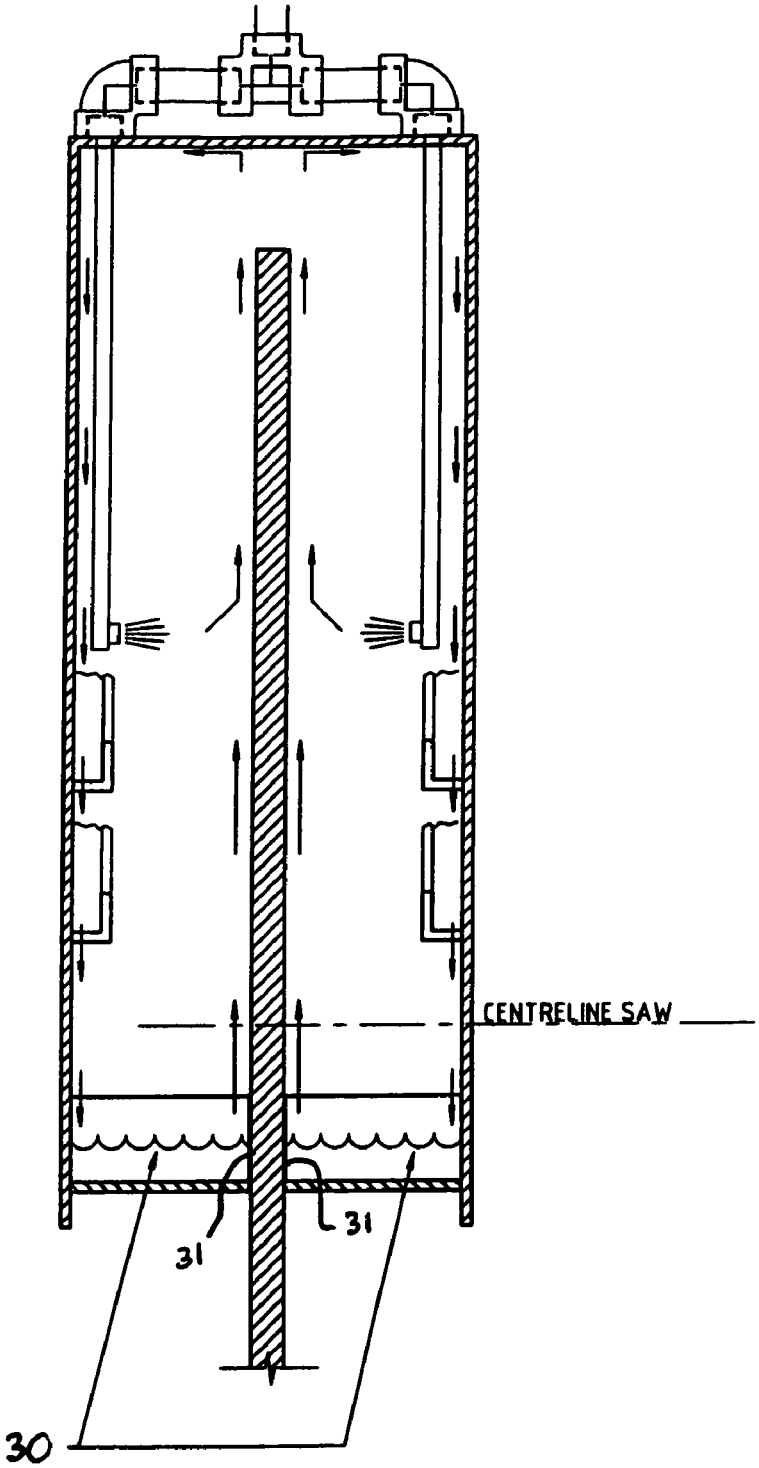
FIG. 4 is a front schematic view of a part of the wet cutting saw of FIG. 3 (through cross-section A) illustrating the flow path of liquid when the saw is being used.

In a variation shown in FIGS. 3 and 4, the wet cutting saw 10 also comprises dams 30 for holding liquid which falls from the openings in the collectors 20. The openings of the collectors 20 are thus positioned vertically above one of the dams 30. A dam 30 is located on the inner surface of each side wall 15, 16, generally towards the bottom of the side walls. The liquid held in the dams 30 is recycled to the blade surface. The dams 30 extend between respective side walls and the blade surface such that an edge 31 of each dam 30 touches or is only slightly spaced from the blade surface. Typically, this edge 31 of the dam which is proximate to the blade is formed of rubber or any other suitable material so that the edge of the dam does not cause any significant wear on the blade when it is rotating. The dams 30 are positioned close to the axle 18 of the blade 11. This is because the liquid moves outwardly across the blade surface towards the blade edge (see FIG. 4) and positioning of the dams 30 in this way facilitates at least the majority of the blade surface being coated with the liquid as it flows onto the blade surface from the dams 30.

The dams 30 are each in the form of a trough and comprise a substantially flat floor member 32 extending between the inner surface of its respective side wall 15, 16 and the blade surface. Wall members 33 on either side of the floor member 32 of each dam 30 also extend between the inner surface of respective side walls and the blade surface so as to hold liquid in the dam and direct it towards the blade surface. The floor member 32 may be inclined towards the blade surface to aid in directing flow of liquid towards the blade surface. However, the dams 30 may provide liquid to the blade surface by any other suitable means such as through an opening in the dam for example.

By collecting and recycling the liquid to the blade surface in accordance with the embodiments shown and described in Figures, the amount of liquid and slurry which flows from the wet cutting saw 10 in use is significantly reduced. Furthermore, because some of the liquid is recycled to the surface of the blade 11, the flow of liquid being fed to the blade surface from the liquid feed conduit 12 can also be reduced. As a result, when using the wet cutting saw 10 according to embodiments of the present invention, significant vacuuming is not required and even for more powerful wet cutting saws a single manually operated vacuum will usually be sufficient.

In another variation, the wet cutting saw may comprise a single collector on each side wall whereby the collectors each have a first end which is located at one end of their respective side walls and a second end located at an opposing end of their respective side walls. Hence, in this arrangement, each collector extends between the ends of their respective side walls. In this variation the collectors facilitate liquid collected by the collectors being directed to a liquid outlet conduit of the hood. The wet cutting saw is configured to return liquid from the liquid outlet conduit to the surface of the blade. This may be via the liquid feed conduit or may be via a separate conduit.

As noted above, the liquid collected in the collectors usually carries some solid particles. The wet cutting saw may comprise a liquid-solid separator (not shown) for separating the solids from the liquid which is directed to the liquid outlet conduit. The separated liquid may then be returned to the blade surface.

This variation also significantly reduces the flow of liquid and slurry away from the wet cutting saw when in use. Accordingly, significant vacuuming is not required and even when using more powerful wet cutting saws according to this embodiment.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

Variations and modifications can be made in respect of the invention described above and defined in the following claims.

The invention claimed is:

1. A wet cutting saw comprising:

a blade rotatable about an axis;

a liquid feed conduit for feeding liquid onto a surface of the blade as it rotates;

a hood comprising a top wall located above the blade and a side wall located to one side of the blade and connected to the top wall;

the wet cutting saw also comprising at least one collector for collecting liquid which leaves the blade surface as it rotates, each collector located at the side wall of the hood and arranged to recycle the collected liquid to the blade surface.

2. A wet cutting saw as claimed in claim 1, wherein each collector comprises a groove, channel or trough formed in or on the side wall.

3. A wet cutting saw as claimed in claim 1, wherein each collector has a first end and a second end, wherein each collector slopes from its first end to its second end so that liquid flows from the first end to the second end.

4. A wet cutting saw as claimed in claim 3, wherein the first end of each collector is located near the perimeter of the side wall and the second end of each collector is located towards the centre of the side wall.

5. A wet cutting saw as claimed in claim 1, wherein each collector comprises an elongate member projecting from a surface of the side wall.

6. A wet cutting saw as claimed in claim 1, wherein each opening is spaced away from the blade surface by 0.5-10 mm.

7. A wet cutting saw as claimed in claim 1, wherein each opening is provided at the end of a projection, projecting from the collector towards the blade.

8. A wet cutting saw as claimed in claim 1, wherein the wet cutting saw also comprises a dam for holding liquid which falls from one or more of the openings in the collectors, the dam arranged to recycle liquid to the blade surface.

9. A wet cutting saw as claimed in claim 8, wherein the dam extends between the side wall and the blade.

10. A wet cutting saw as claimed in claim 8, wherein the dam touches or is only slightly spaced from the blade surface.

11. A wet cutting saw as claimed in claim 8, wherein at least an edge of the dam proximate to the blade is formed of rubber.

12. A wet cutting saw as claimed in claim 8, wherein the dam is positioned close to the axle of the blade.

13. A wet cutting saw as claimed in claim 8, wherein the dam comprises a substantially flat floor member extending between the inner surface of the side wall and the blade surface.

14. A wet cutting saw as claimed in claim 13, wherein the dam comprises wall members on either side of the floor member extending between the inner surface of the side wall and the blade surface.

15. A wet cutting saw as claimed in claim 1, wherein the hood comprises a further side wall connected to the top wall and opposing the other side wall, and wherein the wet cutting saw also comprises at least one collector located at this further side wall for collecting liquid which leaves the blade surface as it rotates and arranged to recycle the collected liquid to the blade surface.

* * * * *